US008662655B2

(12) United States Patent
Furuhata et al.

(10) Patent No.: US 8,662,655 B2
(45) Date of Patent: Mar. 4, 2014

(54) INKJET PRINTER AND METHOD FOR PRINTING

(75) Inventors: Tomotaka Furuhata, Tomi (JP); Yuko Hishida, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 258 days.

(21) Appl. No.: 13/075,192

(22) Filed: Mar. 30, 2011

(65) Prior Publication Data

US 2011/0221818 A1 Sep. 15, 2011

Related U.S. Application Data

(63) Continuation of application No. PCT/JP2010/000047, filed on Jan. 6, 2010.

(30) Foreign Application Priority Data

Jan. 15, 2009 (JP) ..... 2009-006541

(51) Int. Cl.
*B41J 2/01* (2006.01)
*B41J 29/38* (2006.01)

(52) U.S. Cl.
USPC ..... 347/102; 347/16

(58) Field of Classification Search
USPC ..... 347/16, 102
See application file for complete search history.

(56) References Cited

U.S. PATENT DOCUMENTS 5,821,962 A * 10/1998 Kudo et al. ..... 347/65
6,953,245 B2 * 10/2005 Shirakawa ..... 347/102
7,008,042 B2 * 3/2006 Niekawa ..... 347/43
7,140,711 B2 * 11/2006 Nerad et al. ..... 347/19
7,216,955 B2 * 5/2007 Niekawa ..... 347/43
7,261,408 B2 * 8/2007 Otter ..... 347/102
7,393,095 B2 * 7/2008 Oshima et al. ..... 347/102

(Continued)

FOREIGN PATENT DOCUMENTS

CN 1826230 8/2006
DE 10046759 A1 * 4/2002 ..... B05D 3/14

(Continued)

OTHER PUBLICATIONS

International Search Report for corresponding International Application No. PCT/JP2010/000047, Feb. 9, 2010.
Chinese Office Action for corresponding CN Application No. 201080002806.4, Jan. 5, 2013.
Japanese Office Action for corresponding JP Application No. 2009-006541, Apr. 13, 2012.

*Primary Examiner* — Laura Martin
*Assistant Examiner* — Jeremy Bishop
(74) *Attorney, Agent, or Firm* — Ditthavong Mori & Steiner, P.C.

(57) ABSTRACT

An inkjet printer includes a guide rail that faces a medium support member and extends in a scanning direction. A head device includes a carriage movable in the scanning direction along the guide rail. A printer head is mounted on the carriage and is configured to discharge an ink toward a printing medium. An ultraviolet radiation device is mounted on the carriage and is configured to output an ultraviolet radiation toward the printing medium thereby curing the ink that has adhered onto the printing medium after being discharged from the printer head. The ultraviolet radiation device is arranged in the carriage on a side of the printer head in the scanning direction. An intensity controller is configured to control an intensity of the ultraviolet radiation output from the ultraviolet radiation device depending on a direction of movement of the carriage.

12 Claims, 9 Drawing Sheets

(56) References Cited

U.S. PATENT DOCUMENTS

| | | | | |
|---|---|---|---|---|
| 7,419,256 | B2 * | 9/2008 | Niekawa | 347/102 |
| 7,600,867 | B2 * | 10/2009 | Mills et al. | 347/102 |
| 7,712,887 | B2 * | 5/2010 | Kadomatsu et al. | 347/102 |
| 7,758,179 | B2 * | 7/2010 | Niekawa | 347/102 |
| 7,794,075 | B2 * | 9/2010 | Nakano et al. | 347/102 |
| 7,794,076 | B2 * | 9/2010 | Nakano et al. | 347/102 |
| 7,988,259 | B2 * | 8/2011 | Hishida et al. | 347/51 |
| 8,142,009 | B2 * | 3/2012 | Hishida et al. | 347/102 |
| 8,177,350 | B2 * | 5/2012 | Mitsuzawa | 347/102 |
| 2006/0198964 | A1 | 9/2006 | Kaiser | |
| 2007/0115335 | A1 * | 5/2007 | Vosahlo et al. | 347/102 |

FOREIGN PATENT DOCUMENTS

| | | | | |
|---|---|---|---|---|
| GB | 2319406 A | * | 5/1998 | H05B 41/38 |
| JP | 2004-188920 | | 7/2004 | |
| JP | 2004-276584 | | 10/2004 | |
| JP | 2005-74878 | | 3/2005 | |
| JP | 2005-531438 | | 10/2005 | |
| JP | 2007-144637 | | 6/2007 | |
| JP | 2008-132794 | | 6/2008 | |
| JP | 2008-284708 | | 11/2008 | |
| WO | WO 2004/002746 | | 1/2004 | |

* cited by examiner

BACKGROUND ART

INKJET PRINTER AND METHOD FOR PRINTING

CROSS-REFERENCE TO RELATED APPLICATIONS

The present application is a continuation application of International Application No. PCT/JP2010/000047, filed Jan. 6, 2010, which claims priority to Japanese Patent Application No. 2009-006541, filed Jan. 15, 2009. The contents of these applications are incorporated herein by reference in their entirety.

BACKGROUND OF THE INVENTION

1. Field of the Invention

The present invention relates to an inkjet printer and a method for printing.

2. Discussion of the Background

Inkjet printers that perform printing by discharging an ink on a printing medium from a printer head while reciprocating the printer head over the printing medium are known in the art. Some of these inkjet printers perform printing with an ultraviolet curing ink (hereinafter, "UV ink") that dries when exposed to an ultraviolet radiation. Because the UV ink is better in weather resistance and water resistance, a printed material printed with the UV ink can be suitably used as publicity handouts for outdoor advertising, and such printed material is advantageous in having a wide range of applications than a printed material printed with a water-base ink. An inkjet printer that performs printing with the UV ink typically includes an ultraviolet radiation device for drying the UV ink adhering to the printing medium. Recently, inkjet printers have been developed that employ an ultraviolet light emitting diode (hereinafter, "UVLED") as a light source for generating an ultraviolet radiation in the ultraviolet radiation device.

A conventional printing unit 500 mounted on an inkjet printer is shown in FIG. 9A. For explanation purpose, directions shown with arrows in FIG. 9A will be called a front-back direction and a left-right direction. The printing unit 500 mainly includes a printer head 510 that discharges a UV ink, a right ultraviolet radiation device 520R, a left ultraviolet radiation device 520L, and a carriage 530 for mounting these components. The right ultraviolet radiation device 520R and the left ultraviolet radiation device 520L are arranged on a left side and a right side of the printer head 510, respectively. Each of the right ultraviolet radiation device 520R and the left ultraviolet radiation device 520L internally includes a UVLED, and emits an ultraviolet radiation in a lower direction.

When performing printing on a printing line 508 on a printing medium 501, the UV ink is adhered to the printing line 508 in a desired pattern by discharging the UV ink from the printer head 510 while causing the carriage 530 to perform a reciprocating movement (hereinafter, "pass") above the printing line 508 in the left-right direction. Because of the ultraviolet output from the right ultraviolet radiation device 520R and the left ultraviolet radiation device 520L, the UV ink adhering to the printing line 508 is cured when the ultraviolet radiation falls on the printing line 508, and results into printing.

FIG. 9B shows a cross section of the UV ink in a situation where an intensity of the ultraviolet radiation output from the right ultraviolet radiation device 520R and the left ultraviolet radiation device 520L is relatively high. FIG. 9B shows a situation where a UV ink 512 is discharged and adhered in a current pass onto a completely cured UV ink 511 that was discharged, adhered, and completely cured with the ultraviolet radiation in a previous pass. Because the UV ink 512 has bad affinity (difficult to become flat) for the completely cured UV ink 511, the UV ink 512 swells as a granule due to its surface tension, almost does not spread, and is cured in this situation with the ultraviolet radiation.

FIG. 9C shows a cross section of the UV ink in a situation where the intensity of the ultraviolet radiation output from the right ultraviolet radiation device 520R and the left ultraviolet radiation device 520L is relatively low. FIG. 9C shows a situation where a UV ink 514 is adhered in a current pass onto a non-cured UV ink 513 that was adhered but not cured in a previous pass. Because the non-cured UV ink 513 has a good affinity for the UV ink 514, the two inks mix readily and they are cured in this situation with the ultraviolet radiation. Such mixing of the inks can lead to degradation in a printing quality. To take care of this issue, Japanese Patent Application Laid-open No. 2004-276584, for example, discloses a technique in which only a surface of an ink adhering onto a recording medium 2 is first cured with an ultraviolet radiation output from first radiation devices 17, 18, 19, and 20, and then, the ink is completely cured with an ultraviolet radiation output from a second radiation device 21. Moreover, FIG. 1 of Japanese Patent Application Laid-open No. 2008-284708 discloses an inkjet recording apparatus 1 including two light sources 19 and 20 having mutually different illuminances.

SUMMARY OF THE INVENTION

According to one aspect of the present invention, an inkjet printer includes a guide rail, a head device, and an intensity controller. The guide rail faces a medium support member. The guide rail is relatively movable in a moving direction with respect to a printing medium supported by the medium support member. The guide rail extends in a scanning direction substantially perpendicular to the moving direction. The head device includes a carriage, a printer head, and an ultraviolet radiation device. The carriage is movable in the scanning direction along the guide rail. The printer head is mounted on the carriage and is configured to discharge an ink toward the printing medium. The ultraviolet radiation device is mounted on the carriage and is configured to output an ultraviolet radiation toward the printing medium thereby curing the ink that has adhered onto the printing medium after being discharged from the printer head. The ultraviolet radiation device is arranged in the carriage on a side of the printer head in the scanning direction. The intensity controller is configured to control an intensity of the ultraviolet radiation output from the ultraviolet radiation device depending on a direction of movement of the carriage.

According to another aspect of the present invention, a method for printing includes discharging an ink from a printer head of an inkjet printer toward a printing medium while moving the printer head toward a first side along the scanning direction. An ultraviolet radiation having a first intensity is output from an ultraviolet radiation device of the inkjet printer toward a region in the printing medium to cure the ink that has adhered onto the printing medium after being discharged from the printer head while moving the ultraviolet radiation device toward the first side along the scanning direction. An ultraviolet radiation having a second intensity different from the first intensity is output, to cure the ink while the ultraviolet radiation device moves toward a second side opposite to the first side along the scanning direction, toward the region to which the ultraviolet radiation having the first intensity has been irradiated.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
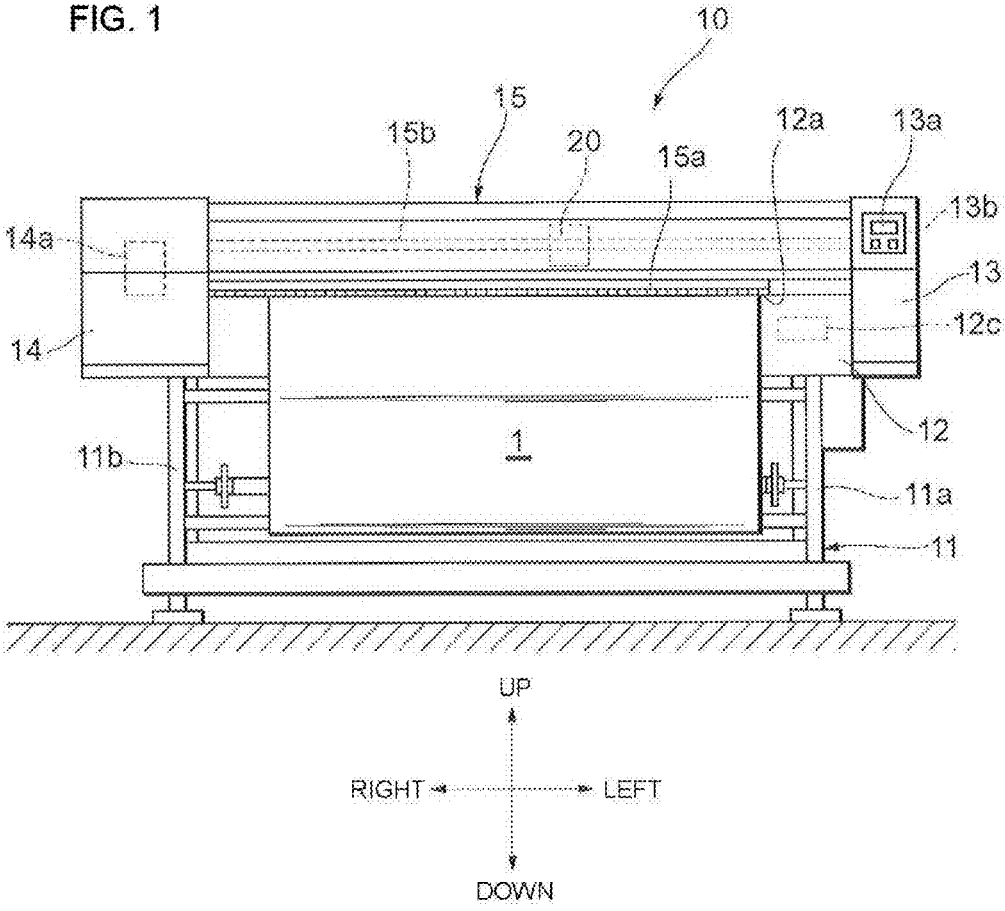
FIG. 1 is a front view of an inkjet printer according to an embodiment of the present invention.
Figure 9A:
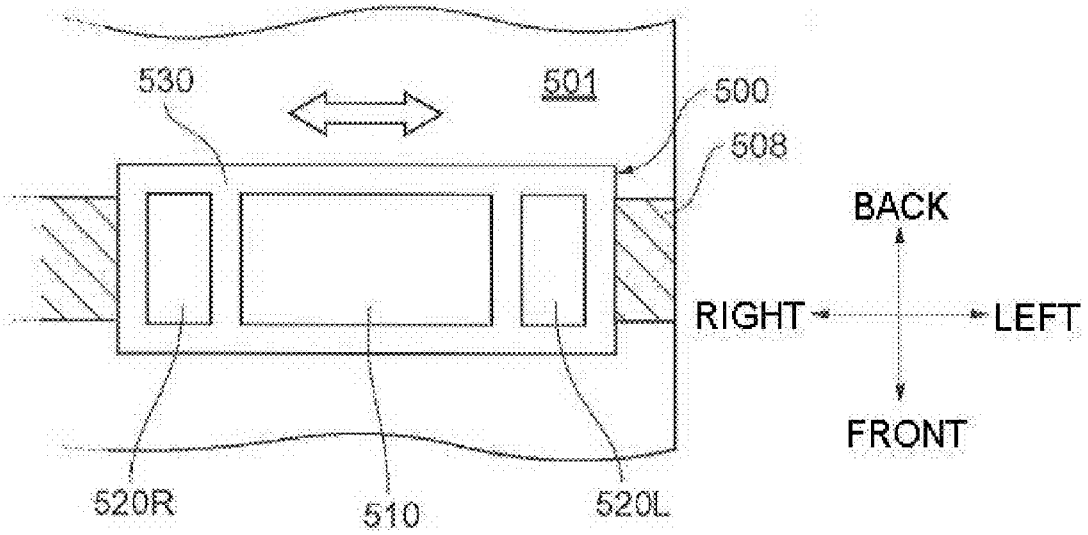
FIG. 9A is a top view of a conventional printing unit.
Figure 9B:
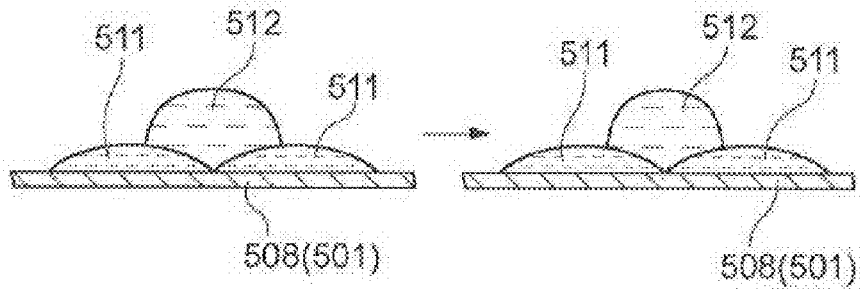
BACKGROUND ART FIG. 9B
FIG. 9B is a cross section of a situation where a UV ink is adhered onto a completely cured UV ink.
Figure 9C:
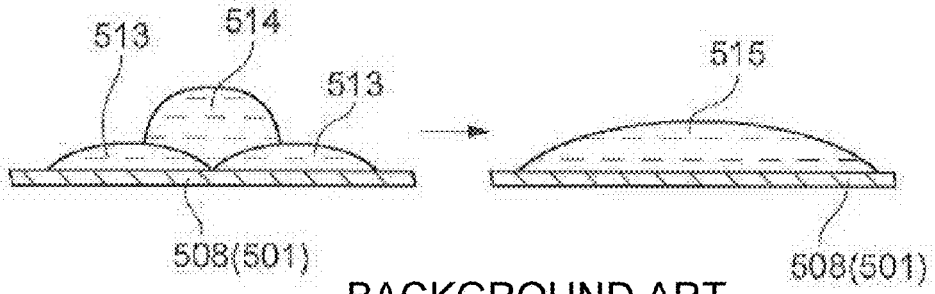
BACKGROUND ART FIG. 9C
FIG. 9C is a cross section of a situation where a UV ink is adhered onto a non-cured UV ink and the two inks got mixed.

The embodiments of the present invention are explained below with reference to the accompanying drawings, wherein like reference numerals designate corresponding or identical elements throughout the various drawings. An explanation will be given with the help of the front-back direction and the left-right direction shown with arrows in FIG. 9A. An overall configuration of an inkjet printer 10 according to the embodiment of the present invention is explained below with reference to FIGS. 1 to 3. FIG. 1 is a front view of the inkjet printer 10, FIG. 2 is a perspective view of a portion around a later-explained printing unit, and FIG. 3 depicts a control system.

The inkjet printer 10, as shown in FIG. 1, includes a supporting frame 11 having a left supporting leg 11*a* and a right supporting leg 11*b*, a central body 12 supported by the supporting frame 11, a left body 13 arranged on the left side of the central body 12, a right body 14 arranged on the right side of the central body 12, an upper body 15 connecting the left body 13 and the right body 14 and arranged above the central body 12 with a gap therebetween. A platen 12*a* that extends in the left-right direction and whose top surface is exposed is provided on the central body 12.

Figure 2:
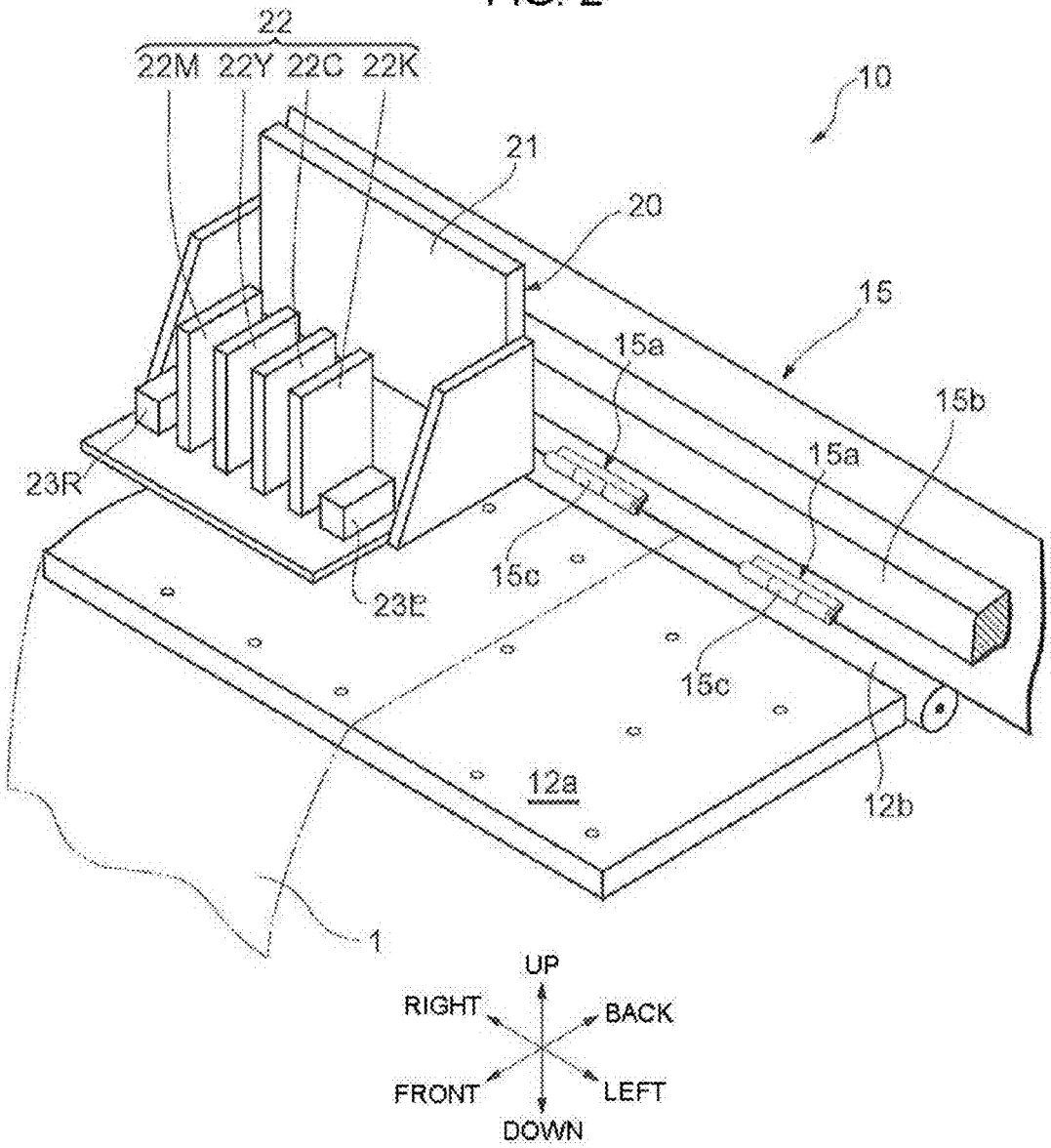
FIG. 2 is a perspective view of a portion of the inkjet printer around a printing unit.
Figure 3:
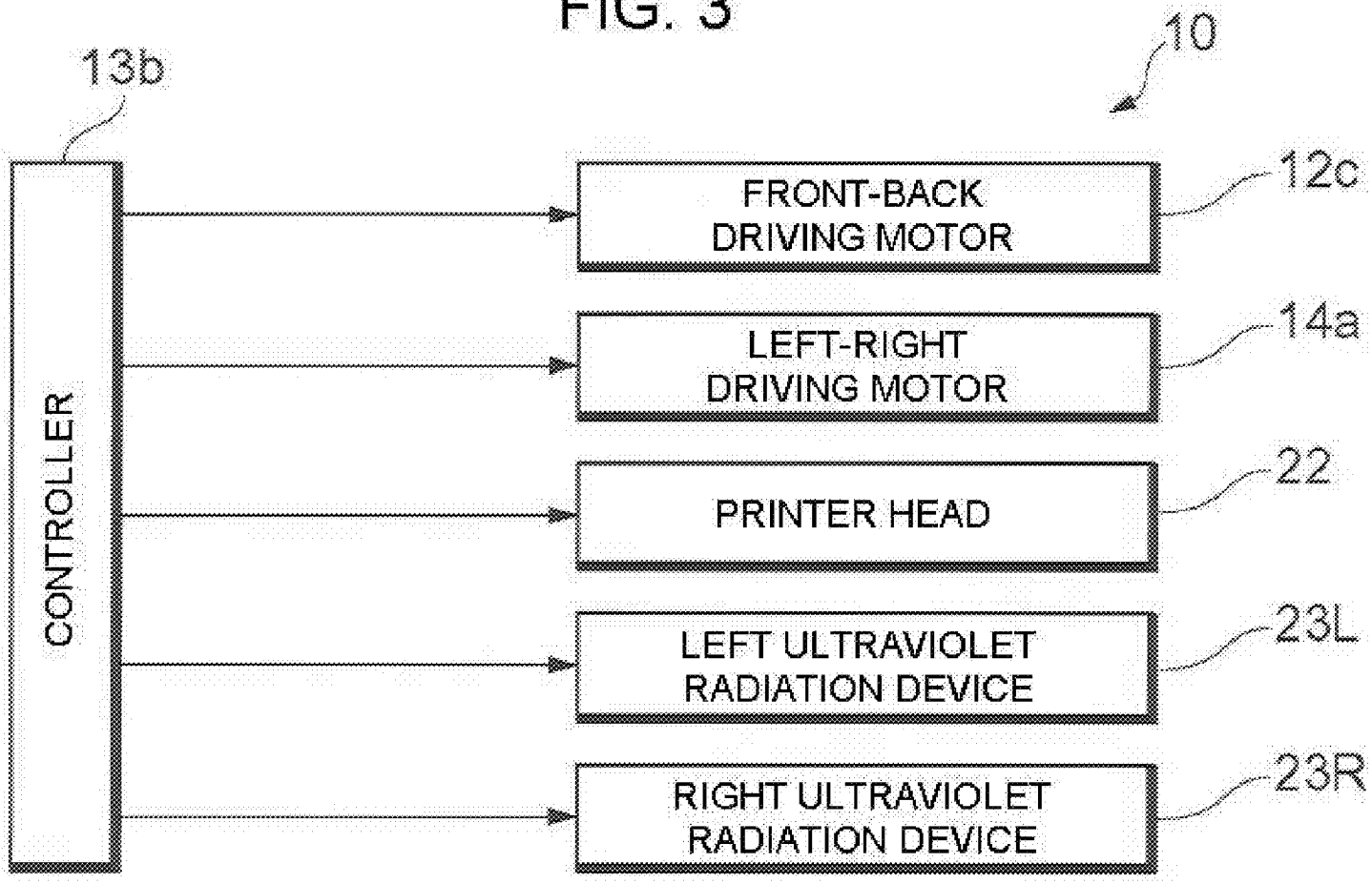
FIG. 3 depicts a control system of the inkjet printer.

As shown in FIG. 2, a plurality of clamping units 15*a* is arranged in the left-right direction below the upper body 15. A pinch roller 15*c* is rotatably arranged opposite each of the clamping units 15*a*. A cylindrical feed roller 12*b* is arranged in the left-right direction below the pinch roller 15*c* and the feed roller 12*b* is in contact with the platen 12*a*. The feed roller 12*b* is driven by a front-back driving motor 12*c* (see FIG. 1) arranged inside the central body 12.

The clamping unit 15*a* can be set in a clamping position at which the pinch roller 15*c* is in pressure contact with the feed roller 12*b* and an unclamping position in which the pinch roller 15*c* is separated from the feed roller 12*b*. When a long printing sheet 1 as a printing target is sandwiched between the pinch roller 15*c* and the feed roller 12*b* by setting the clamping unit 15*a* in the clamping position, the printing sheet 1 can be moved in the front direction or the back direction for a desired distance by driving the front-back driving motor 12*c*.

As shown in FIG. 1, an operating unit 13*a* that includes various operating switches and display panels is arranged on a front surface of the left body 13. Moreover, a controller 13*b* is arranged inside the left body 13. As shown in FIG. 3, the controller 13*b* is electrically connected to, in addition to the front-back driving motor 12*c*, a left-right driving motor 14*a*, a printer head 22, a left ultraviolet radiation device 23L, a right ultraviolet radiation device 23R, etc., that are explained later, and that controls operations of these structural components by sending operation signals to these structural components.

As shown in FIG. 2, a guide rail 15*b* that extends in a scanning direction substantially corresponding to the left-right direction is arranged inside the upper body 15. The guide rail 15*b* is relatively movable in a moving direction substantially corresponding to the front-back direction with respect to the printing sheet 1 supported by the platen 12*a*. The scanning direction is substantially perpendicular to the moving direction. A printing unit 20 is arranged along the guide rail 15*b* in a reciprocatable manner in the left-right direction. The printing unit 20 mainly includes a carriage 21, the printer head 22, the left ultraviolet radiation device 23L, and the right ultraviolet radiation device 23R.

The carriage 21 is movable in the left-right direction with respect to the guide rail 15*b*. The carriage 21 is reciprocated along the left-right direction along the guide rail 15*b* by a left-right driving motor 14*a* arranged inside the right body 14. The carriage 21 serves as a platform for mounting the printer head 22, the left ultraviolet radiation device 23L, and the right ultraviolet radiation device 23R.

The printer head 22 includes, for example, printer heads 22M, 22Y, 22C, and 22K of magenta (M), yellow (Y), cyan (C), and black (K), respectively. The printer head 22 is connected to a not-shown ink cartridge with an ink supply tube. A plurality of ink nozzles (not shown) is provided on a lower face of the printer heads 22M, 22Y, 22C, and 22K, respectively, for discharging a UV ink in a downward direction.

The left ultraviolet radiation device 23L is arranged on the left side of the printer head 22 (22K). A plurality of UVLED modules (not shown) including UVLED chips (not shown) capable of outputting ultraviolet radiations of intensities corresponding to magnitudes of electric currents supplied to them is arranged inside the left ultraviolet radiation device 23L. The UVLED chip has characteristics such that, for example, it outputs an ultraviolet radiation of an intensity that increases in proportion to the magnitude of the electric current supplied to it. The ultraviolet radiation output from the UVLED chip is directed in a downward direction of the left ultraviolet radiation device 23L (on the printing sheet 1).

The controller 13*b* can control the intensity of the ultraviolet radiation output from the left ultraviolet radiation device 23L in the downward direction by controlling the magnitude of the electric current supplied to the UVLED module (UVLED chip) arranged inside the left ultraviolet radiation device 23L. The UVLED module is of a type that can immediately respond to a change in the magnitude of the electric current supplied to the UVLED module in response to such a control and outputs an ultraviolet radiation of an intensity corresponding to the magnitude of the electric current.

As can be understood even from FIG. 3, the controller 13*b* can separately control the intensities of the ultraviolet radiations output from each of the left ultraviolet radiation device 23L and the right ultraviolet radiation device 23R. Meanwhile, the intensity control of the ultraviolet radiations can be performed by changing the supplied electric current in a step-less manner. For example, the magnitude of the supplied electric current can be changed as desired to say 30% or 50% of the maximum electric current that can be supplied to the UVLED chip thereby radiating an ultraviolet radiation of a desired intensity. The right ultraviolet radiation device 23R arranged on the right side of the printer head 22 (22M) has the same configuration as that of the left ultraviolet radiation device 23L, and therefore, its explanation is omitted herefrom.

The explanation up to here was an explanation about an overall configuration of the inkjet printer 10. A method of printing on the printing sheet 1 with the inkjet printer 10 is explained below while referring to FIGS. 4A, 4B, 5A, 5B, and 6A to 6E. FIGS. 4A, 4B, 5A, and 5B are schematic diagrams of the printing unit 20 when seen from above, and FIGS. 6A to 6E depict cross sections of UV inks adhered in an overlapping manner in each pass.

The method of printing is explained below by taking an example in which printing is performed in four passes (a situation where printing is performed by adhering the UV ink four times in the overlapping manner). Moreover, a situation is explained in which the intensity of the ultraviolet radiation output from each of the left ultraviolet radiation device 23L and the right ultraviolet radiation device 23R is controlled by the controller 13*b* to a maximum intensity (100%) and a half intensity (50%), which is half of the maximum intensity, depending on a direction of movement of the carriage 21.

The method of printing in broad terms is as follows. The UV ink is adhered onto the printing sheet 1 in a desired pattern by discharging the UV ink from the ink nozzles provided on the lower face of the printer head 22 while causing the printing unit 20 to perform a reciprocating movement along the left-right direction along the guide rail 15*b* above the printing sheet 1 arranged on an upper face of the platen 12*a*. When the ultraviolet radiations output from the right ultraviolet radiation device 23R and the left ultraviolet radiation device 23L fall on the printing sheet 1, the UV ink adhering to the printing sheet 1 is cured with the ultraviolet radiations resulting into printing.

Meanwhile, if 100% of the UV ink is discharged at one time so as to achieve the desired printing pattern (i.e., printing is performed in a single pass), a large quantity of non-cured UV ink all together adheres onto a surface of the printing sheet 1 and this can lead to mixing of the UV inks. To take care of this issue, in the inkjet printer 10, for example, the printing unit 20 is caused to perform the reciprocating movement over the printing sheet 1 four times along the left-right direction while discharging only 25% of the UV ink from the printer head 22 thereby finally adhering 100% of the UV ink in total onto the printing sheet 1. By adapting this technique, printing in which mixing of the inks has been suppressed can be achieved. The method of printing is explained in detail below.

Figure 4A:
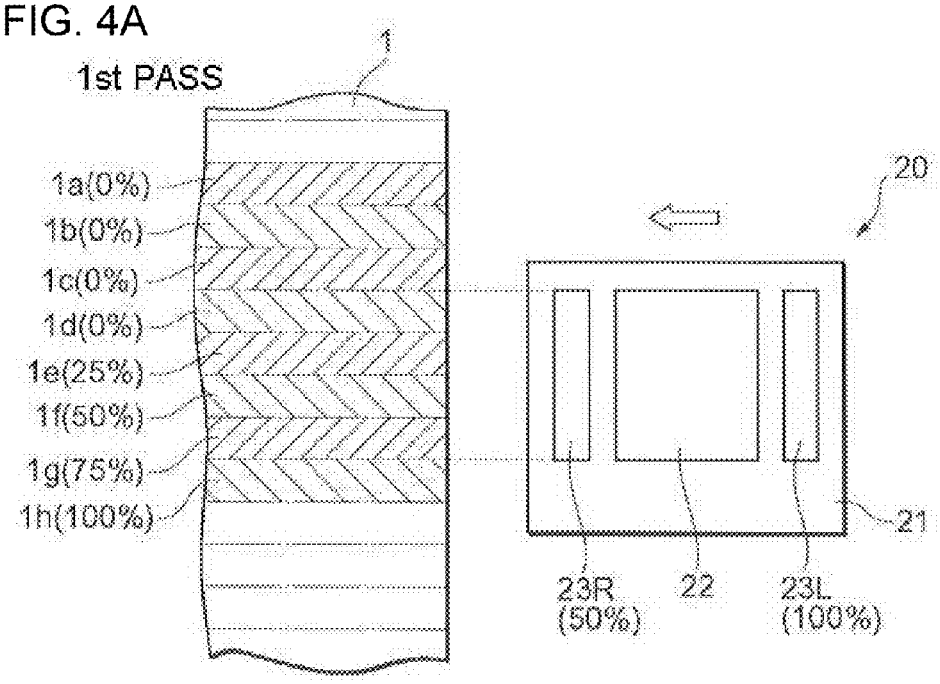
FIGS. 4A and 4B are schematic diagrams of the printing unit when seen from above and depict situations in a 1st pass and a 2nd pass, respectively.
Figure 4B:
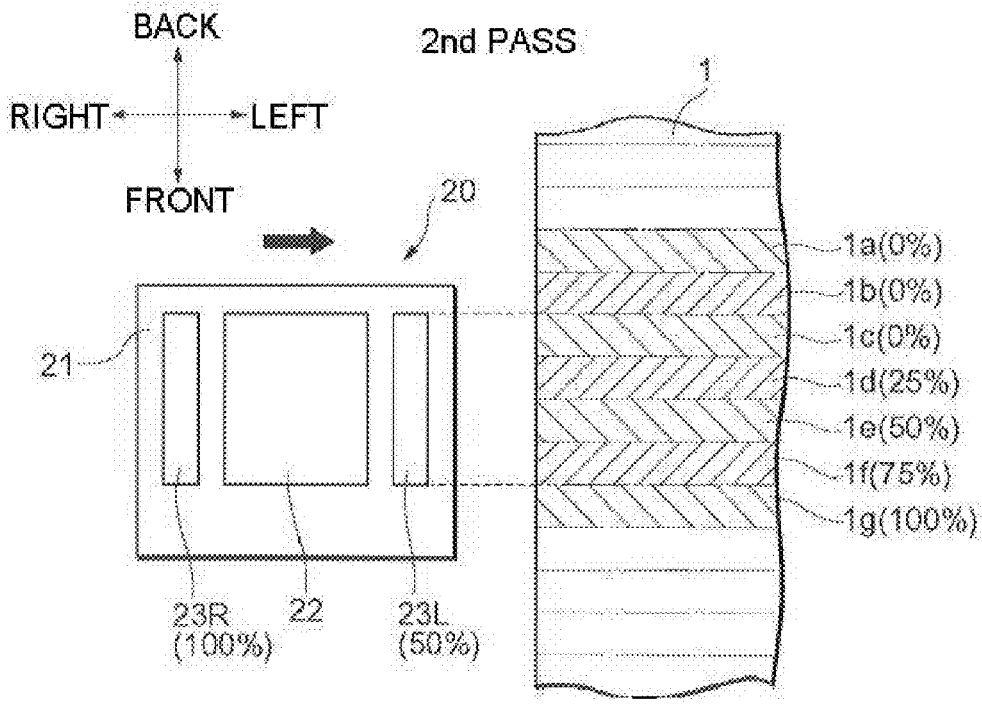

A top part of FIGS. 4A and 4B depicts a situation where, during the printing process, the printing unit 20 is positioned, for example, on the left side of a left edge of the printing sheet 1. As understood from FIGS. 4A and 4B, a width of the right ultraviolet radiation device 23R and a width of the left ultraviolet radiation device 23L in the front-back direction are the same as a width of the printer head 22 in the front-back direction. Moreover, the right ultraviolet radiation device 23R and the left ultraviolet radiation device 23L are mounted, respectively, on the right side and the left side of the printer head 22 in the carriage 21. It is assumed that printing regions 1*a* to 1*d* on the printing sheet 1 are in a non-printed state (0% ink) where no UV ink is adhered, a printing region 1*e* is in a state where the UV ink for one pass is adhered (25% ink), a printing region 1*f* is in a state where the UV ink for two passes is adhered (50% ink), a printing region 1*g* is in a state where the UV ink for three passes is adhered (75% ink), and a printing region 1*h* is in a state where the UV ink for four passes is adhered (100% ink). A width in the front-back direction of these printing regions 1*a* to 1*h* is equivalent to one-time feed distance of the front-back driving motor 12*c*.

In the state shown in the top part of FIGS. 4A and 4B, the controller 13*b* executes a flowing control. That is, the controller 13*b* drives the left-right driving motor 14*a* to move the printing unit 20 toward the right direction, causes the printer head 22 to discharge the UV ink for one pass, and causes the right ultraviolet radiation device 23R to output the ultraviolet radiation of 50% intensity and causes the left ultraviolet radiation device 23L to output the ultraviolet radiation of 100% intensity. As a result, each of the printing regions 1*d* to 1*g* are irradiated with the ultraviolet radiation of 50% intensity output from the right ultraviolet radiation device 23R, then the UV ink for one pass is discharged from the printer head 22 in each of the printing regions 1*d* to 1*g*, and finally each of the printing regions 1*d* to 1*g* are irradiated with the ultraviolet radiation of 100% intensity output from the left ultraviolet radiation device 23L. This leads to a situation where the UV ink for one pass is adhered onto the printing region 1*d*, the UV ink for two passes is adhered onto the printing region 1*e*, the UV ink for three passes is adhered onto the printing region 1*f*, and the UV ink for four passes is adhered onto the printing region 1*g* (this situation is called a 1st pass).

Figure 6A:
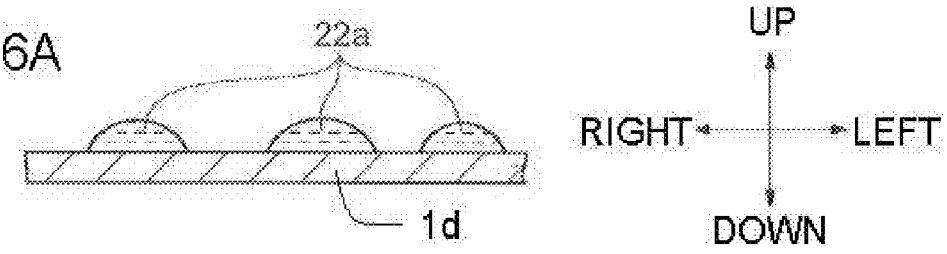
FIGS. 6A, 6B, 6C, 6D, and 6E schematically depict overlapping of UV inks in each pass.
Figure 6B:
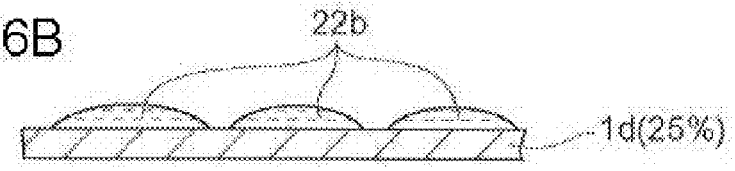

FIG. 6A shows a cross section of a situation immediately after a UV ink 22*a* is adhered onto the printing region 1*e* in the 1st pass, and FIG. 6B shows a cross section of a situation after completion of the 1st pass where the UV ink 22*a* has become flat as a UV ink 22*b*. As understood from these figures, after the UV ink 22*a* is adhered in the printing region 1*d* in the form of droplets, the UV ink 22*a* is cured by about 50% with the ultraviolet radiation of 100% intensity output from the left ultraviolet radiation device 23L. Because the UV ink 22*a* is only partially cured at this stage, there is time for the UV ink 22*a* to become flat during the 1st pass.

In the 1st pass, after the printing unit 20 has moved to a right edge of the printing sheet 1, the printing sheet 1 is moved in the front direction by driving the front-back driving motor 12*c*, for example, for a distance equivalent to the width of the printing region 1*d* in the front-back direction. The controller 13*b*, after controlling the left ultraviolet radiation device 23L so as to output the ultraviolet radiation of 100% intensity and the right ultraviolet radiation device 23R so as to output the ultraviolet radiation of 50% intensity, causes the printer head 22 to discharge the UV ink for one pass while moving the printing unit 20 in the left direction. As a result, each of the printing regions 1*c* to 1*f* are irradiated with the ultraviolet radiation of 50% intensity output from the left ultraviolet radiation device 23L, then the UV ink for one pass is discharged from the printer head 22 in each of the printing regions 1*c* to 1*f*, and finally each of the printing regions 1*c* to 1*f* are irradiated with the ultraviolet radiation of 100% intensity output from the right ultraviolet radiation device 23R. This leads to a situation where the UV ink for one pass is adhered to the printing region 1*c*, the UV ink for two passes is adhered to the printing region 1*d*, the UV ink for three passes is adhered to the printing region 1*e*, and the UV ink for four passes is adhered to the printing region 1*f* (this situation is called a 2nd pass).

Figure 6C:
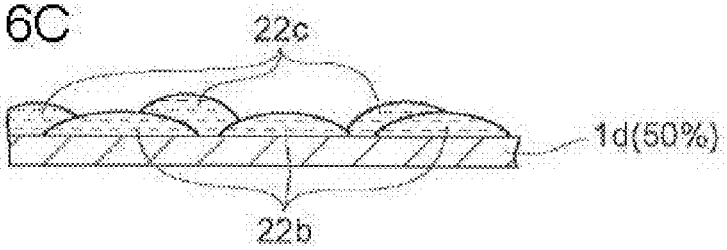

FIG. 6C shows a cross section of the printing region 1*d* at the completion of the 2nd pass. The printing region 1*d* in the 2nd pass is explained below with reference to FIG. 6C. The UV ink 22*b* that has become flat in the 1st pass is cured (for example, by about 75%) with the ultraviolet radiation of 50% intensity output from the left ultraviolet radiation device 23L to such an extent that the UV ink does not mix with other UV ink even when it comes in contact with the other ink. Because a UV ink 22*c* discharged from the printer head 22 adheres in the printing region 1*d* in this state, the UV ink 22*c* does not mix with the UV ink 22*b*. Subsequently, the UV ink 22*c* is cured by, for example, about 50% with the ultraviolet radiation of 100% intensity output from the right ultraviolet radiation device 23R, so that, by the reason explained in connection to the 1st pass, the UV ink 22*c* becomes flat during the 2nd pass.

Figure 5A:
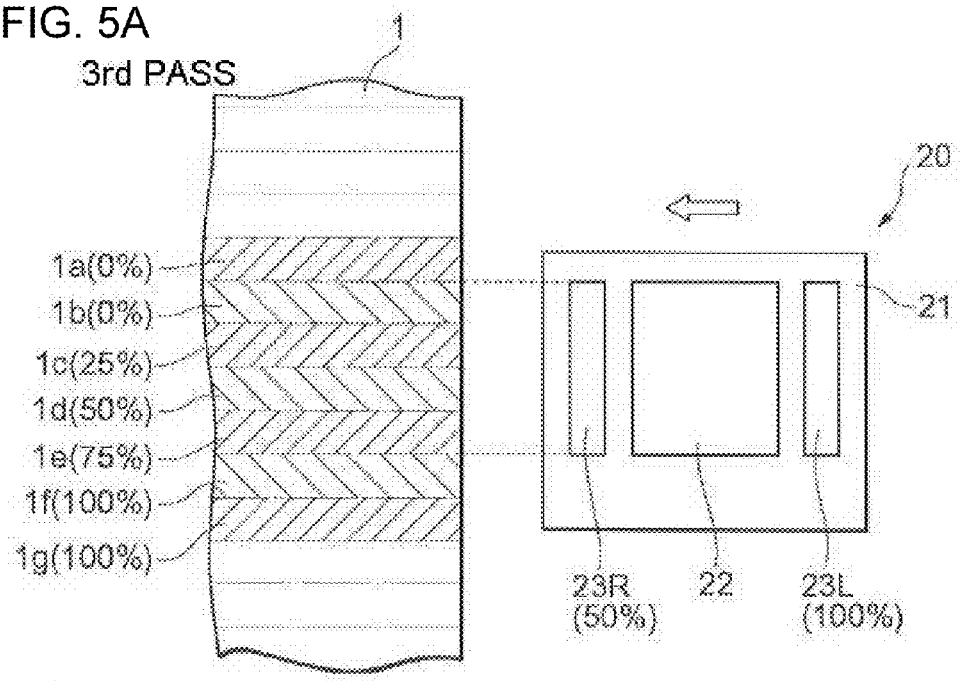
FIGS. 5A and 5B are schematic diagrams of the printing unit when seen from above and depicts situations in a 3rd pass and a 4th pass, respectively.
Figure 5B:
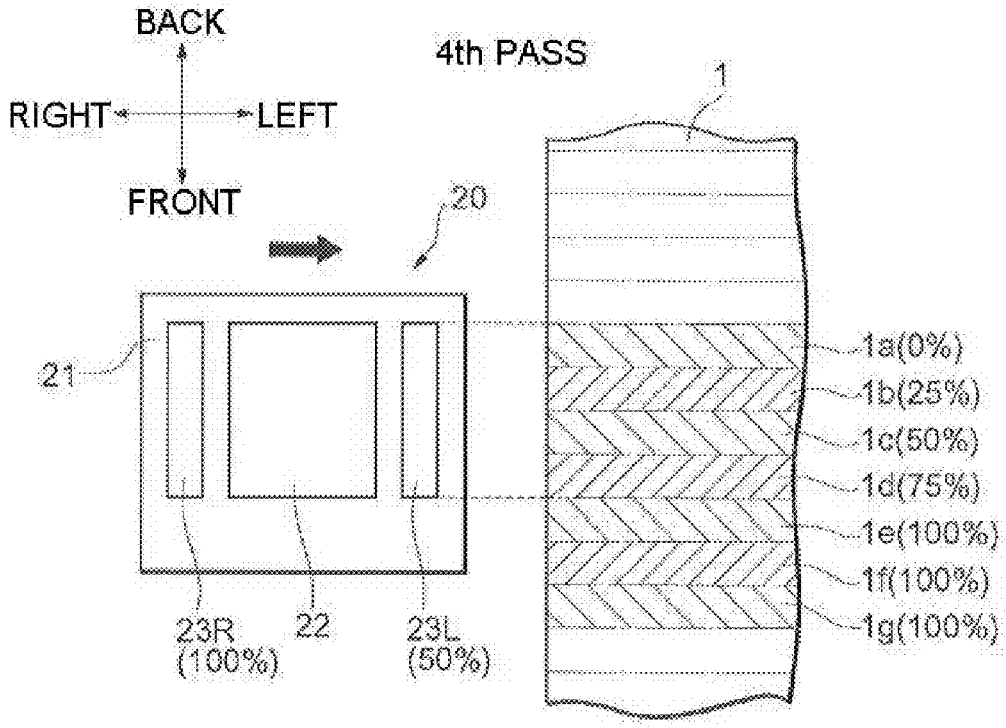

In the 2nd pass, after the printing unit 20 has moved to the left edge of the printing sheet 1, in the same manner as in the 1st pass, the printing sheet 1 is moved in the front direction (see top part of FIGS. 5A and 5B). The controller 13*b*, after controlling the right ultraviolet radiation device 23R so as to output the ultraviolet radiation of 50% intensity and the left ultraviolet radiation device 23L so as to output the ultraviolet radiation of 100% intensity, causes the printer head 22 to discharge the UV ink for one pass while moving the printing unit 20 in the right direction. This leads to a situation where the UV ink for one pass is adhered to the printing region 1*b*, the UV ink for two passes is adhered to the printing region 1*c*, the UV ink for three passes is adhered to the printing region 1*d*, and the UV ink for four passes is adhered to the printing region 1*e* (this situation is called a 3rd pass).

Figure 6D:
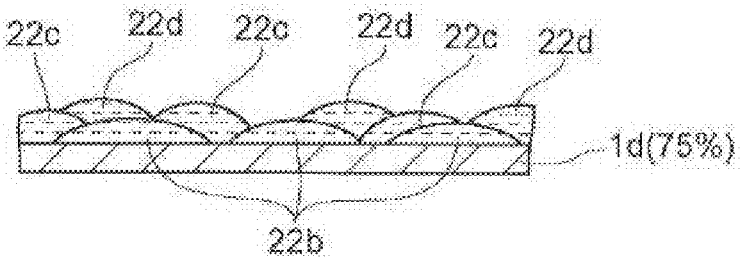

The printing region 1*d* in the 3rd pass is explained below with reference to FIG. 6D. The UV ink 22*c* that has become flat in the 2nd pass is cured (for example, by about 75%) with the ultraviolet radiation of 50% intensity output from the right ultraviolet radiation device 23R to such an extent that the UV ink does not mix with the other UV ink. Because a UV ink 22*d* discharged from the printer head 22 adheres in the printing region 1*d* in this state, the UV ink 22*d* does not mix with the UV ink 22*c* (and the UV ink 22*b*). Subsequently, the UV ink 22*d* is cured by, for example, about 50% with the ultraviolet radiation of 100% intensity output from the left ultraviolet radiation device 23L, so that the UV ink 22*d* becomes flat during the 3rd pass.

In the 3rd pass, after the printing unit 20 has moved to the right edge of the printing sheet 1, in the same manner as in the 2nd pass, the printing sheet 1 is moved in the front direction (see bottom part of FIGS. 5A and 5B). The controller 13*b*, after controlling the left ultraviolet radiation device 23L so as to output the ultraviolet radiation of 100% intensity and the right ultraviolet radiation device 23R so as to output the ultraviolet radiation of 50% intensity, causes the printer head 22 to discharge the UV ink for one pass while moving the printing unit 20 in the left direction. This leads to a situation where the UV ink for one pass is adhered to the printing region 1*a*, the UV ink for two passes is adhered to the printing region 1*b*, the UV ink for three passes is adhered to the printing region 1*c*, and the UV ink for four passes is adhered to the printing region 1*d* (this situation is called a 4th pass). The printing in the printing region 1*d* completes after completion of the 4th pass.

Figure 6E:
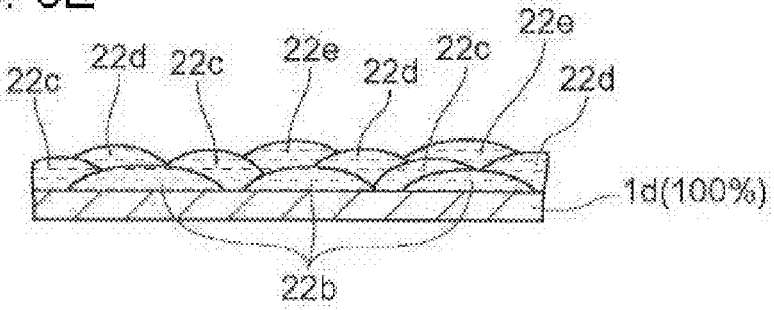

The printing region 1*d* in the 4th pass is explained below with reference to FIG. 6E. The UV ink 22*d* that has become flat in the 3rd pass is cured (for example, by about 75%) with the ultraviolet radiation of 50% intensity output from the left ultraviolet radiation device 23L to such an extent that the UV ink does not mix with the other UV ink. Because a UV ink 22*e* discharged from the printer head 22 adheres in the printing region 1*d* in this state, the UV ink 22*e* does not mix with the UV ink 22*d* (and the UV ink 22*b* and the UV ink 22*c*). Subsequently, the UV ink 22*e* is cured by, for example, about 50% with the ultraviolet radiation of 100% intensity output from the right ultraviolet radiation device 23R, so that the UV ink 22*e* becomes flat during the 4th pass.

As explained above, the inkjet printer 10, to which the embodiment of the present invention has been applied, separately controls the intensity of the ultraviolet radiation output from each of the left ultraviolet radiation device 23L and the right ultraviolet radiation device 23R depending on the direction of movement (the left direction or the right direction) of the printing unit 20. Thus, because the UV ink adhered to the printing sheet 1 can be cured by only about 50% with the first ultraviolet radiation, the UV ink becomes flat with the passage of time. Then, the UV ink is irradiated with the ultraviolet radiation of an intensity that is lower than that of the first ultraviolet radiation by controlling the intensity of the ultraviolet radiation with the controller 13*b* thereby curing the UV ink by about 75%, so that the UV ink is cured to such an extent that it does not mix with the other UV ink even if it comes in contact with the other UV ink.

Thus, the UV ink in the current pass can be overlapped on the UV ink that was adhered onto the printing sheet 1 in the previous pass and that has become flat and that is cured to such an extent that the two inks do not mix. By repeating such adhering of the UV inks and irradiation of the ultraviolet radiation, the UV inks can be cured in a situation where the UV inks have not mixed and have become sufficiently flat. Hue shading of the printed material obtained in this manner does not look different than that of the desired printed material, which means that a high quality printed material can be obtained.

Figure 7A:
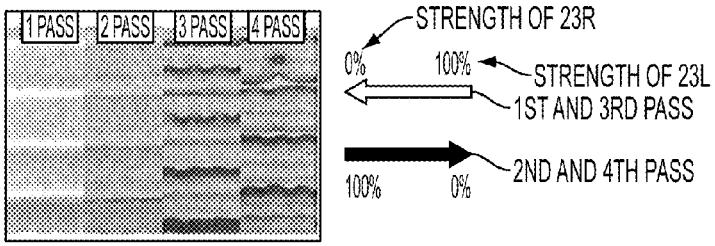
FIGS. 7A, 7B, 7C, 7D, and 7E schematically depict a printing appearance for each ultraviolet radiation intensity per pass when printing is performed while varying intensities of ultraviolet radiations output from an ultraviolet radiation device.
Figure 7B:
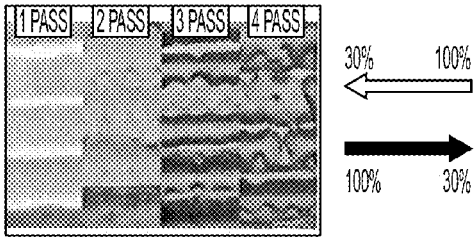
Figure 7C:
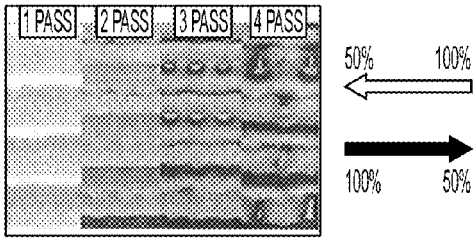

FIG. 7C schematically depicts an example of the surface of the printing sheet 1 per pass in two situations: 1) when moving the printing unit 20 in the right direction, the ultraviolet radiation of 50% is output from the right ultraviolet radiation device 23R and the ultraviolet radiation of 100% is output from the left ultraviolet radiation device 23L, and 2) when moving the printing unit 20 in the left direction, the ultraviolet radiation of 100% is output from the right ultraviolet radiation device 23R and the ultraviolet radiation of 50% is output from the left ultraviolet radiation device 23L.

In the example of FIG. 7C, for example, a UV ink manufactured by Mimaki Engineering Co., Ltd. is used as the UV ink, Controltac 180-10 manufactured by 3M is used as the printing sheet 1, and UJV-160 manufactured by Mimaki Engineering Co., Ltd. is used as the inkjet printer 10. FIG. 7C depicts results when an internal printing pattern of the inkjet printer 10 is printed at a resolution of 600 dots per inch in four passes. Moreover, a UVLED module having a maximum illuminance of 750 mW/cm$^2$ at an electric current of 0.5 ampere was used.

Figure 7D:
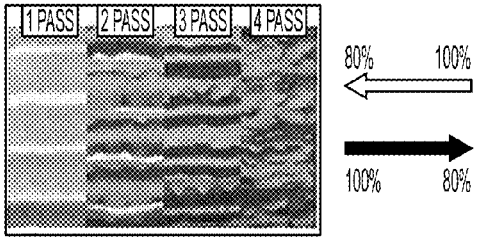
Figure 7E:
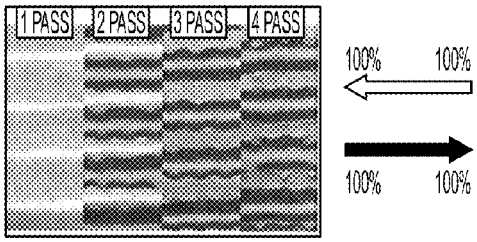

For comparison with the situation shown in FIG. 7C, FIG. 7A shows a situation in which the intensity of the ultraviolet radiation can be controlled to 0% or 100% depending on the direction of movement of the printing unit 20, FIG. 7B shows a situation in which the intensity of the ultraviolet radiation can be controlled to 30% or 100% depending on the direction of movement of the printing unit 20, FIG. 7D shows a situation in which the intensity of the ultraviolet radiation can be controlled to 80% or 100% depending on the direction of movement of the printing unit 20, FIG. 7E shows a situation in which the intensity of the ultraviolet radiation is always controlled to 100%, and printing is performed on the surface of the printing sheet 1.

Figure 8A:
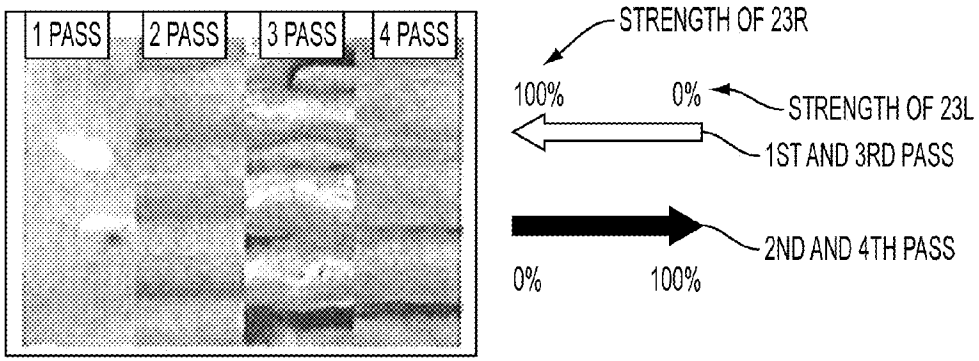
FIGS. 8A and 8B schematically depict a printing appearance for each ultraviolet radiation intensity per pass when printing is performed while varying intensities of ultraviolet radiations output from an ultraviolet radiation device.
Figure 8B:
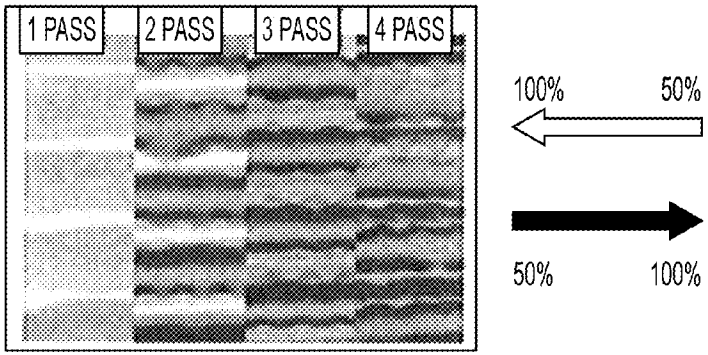

FIGS. 7A to 7E depict situations where the intensity of the ultraviolet radiation output from the ultraviolet radiation device located downstream in the direction of movement of the printing unit 20 is controlled to 100%, and in contrast, FIGS. 8A and 8B depict situations where the intensity of the ultraviolet radiation output from the ultraviolet radiation device located upstream in the direction of movement of the printing unit 20 is controlled to 100%. FIG. 8A shows a result when the intensity of the ultraviolet radiation is controlled to 100% or 0%, and FIG. 8B shows a result when the intensity of the ultraviolet radiation is controlled to 100% or 50%.

In FIGS. 7A to 8B, portions with a distinct shading boundary represent portions where the UV inks have not mixed, but the UV inks have bounced off each other and have not become sufficiently flat. In contrast, portions with an indistinct shading boundary represent portions where the UV inks have relatively mixed. When the 4th passes in FIGS. 7A to 7E and FIGS. 8A and 8B are compared, in the above explained device configuration, the situation shown in FIG. 7C is a situation where the mixing of the UV inks is less and the UV inks have become sufficiently flat.

Thus, in the above embodiment, a relatively good result is obtained from the view point of mixing and flattening of the UV inks when the intensity of the ultraviolet radiation output from the ultraviolet radiation device located upstream in the direction of movement of the printing unit 20 is controlled to 50% and the intensity of the ultraviolet radiation output from the ultraviolet radiation device located downstream in the direction of movement of the printing unit 20 is controlled to 100%.

Meanwhile, the control of the intensities of the ultraviolet radiations output from the left ultraviolet radiation device 23L and the right ultraviolet radiation device 23R is not limited to the above explained control. The control of the intensities can be changed depending on, for example, a material of the printing sheet 1, component characteristics of the UV ink, specifications of the UVLED module, etc., to obtain optimal results.

Meanwhile, although the method of printing is explained with four passes, the method of printing is not limited to four passes. For example, the quality of printing can be further increased by performing the printing with eight passes by setting the one-time feed distance of the printing sheet 1 by the front-back driving motor 12*c* to ⅛ of the front-back width of the printer head 22.

In the above embodiment, the embodiment of the present invention is applied to the inkjet printer 10 that performs printing by causing the printing unit 20 to perform the reciprocating movement in the left-right direction while feeding the printing sheet 1 in the front direction, however, the embodiment of the present invention can be applied to an inkjet printer having a different configuration than the inkjet printer 10. For example, the embodiment of the present invention can be applied to a so called flatbed inkjet printer that performs printing on a printing medium placed on and fixed to a plate-shaped bed by causing a printing unit to perform a reciprocating movement in the left-right direction while feeding the printing unit in the front-back direction.

The inkjet printer according to the embodiment of the present invention is configured so as to control with the intensity controlling unit the intensity of the ultraviolet radiation output from the ultraviolet radiation unit depending on a direction of movement of the carriage. Therefore, when curing the ink adhered to the printing medium by irradiating the ink with the ultraviolet radiation output from the ultraviolet radiation unit multiple times, the ink is irradiated with the ultraviolet radiation of different intensity each time. With such a configuration, for example, it is possible to cure the ink to some extent in one irradiation of the ultraviolet radiation so that there is time for the ink to become flat, and to cure the ink in the subsequent irradiation of the ultraviolet radiation to such an extent that the ink does not mix with a new ink adhering on it. By repeating such adhering of the inks and irradiation of the ultraviolet radiation, the inks can be cured in a situation where the inks have not mixed and have become sufficiently flat.

It is preferable that the ultraviolet radiation unit independently controls the intensities of the ultraviolet radiations output from the first ultraviolet radiation unit and the second ultraviolet radiation unit arranged on either side of the printer head. With this configuration, by moving the head unit in one of the scanning directions, the ink can be irradiated two times with the ultraviolet radiations of different intensities before and after the ink is adhered. Therefore, the intensity of the ultraviolet radiation can be chosen optimally depending on, for example, a material of the printing medium, component characteristics of the ink, etc. In this manner, because the ink can be irradiated with the ultraviolet radiation of an optimum intensity at an optimum timing, and mixing of the inks can be suppressed and the inks can be cured after the inks have become flat, the printing quality can be further enhanced.

It is preferable that the intensity controlling unit performs a control such that ratios of intensities of the ultraviolet radiations of the first ultraviolet radiation unit and the second ultraviolet radiation unit are substantially equal depending on the direction of movement of the carriage. By configuring in this manner, because the intensity controlling unit can, for example, simply alternately repeat two control patterns depending on the direction of movement of the intensity controlling unit, the configuration of the intensity controlling unit can be made simple.

It is preferable that the ultraviolet radiation unit includes a light emitting diode capable of outputting an ultraviolet radiation. By configuring in this manner, because the light emitting diode can be controlled by controlling a magnitude of an electric current supplied to it, the ultraviolet radiation matching with the magnitude of the electric current can be immediately output. Therefore, for example, even if the head unit is moved in the scanning direction at a relatively high speed, the intensity controlling unit can quickly change the intensities of the ultraviolet radiations and the ink can be irradiated with the ultraviolet radiations of the desired intensities.

A method of printing according to the embodiment of the present invention includes a first step including, while moving the printer head and the ultraviolet radiation unit toward a first side along the scanning direction, causing the printer head to discharge the ink and causing the ultraviolet radiation unit to output the ultraviolet radiation while controlling an intensity of the ultraviolet radiation; and a second step including, while moving the ultraviolet radiation unit toward a second side along the scanning direction, causing the ultraviolet radiation unit to output the ultraviolet radiation while controlling an intensity of the ultraviolet radiation to be different from the intensity of the ultraviolet radiation output in the first step in a region on the printing medium that is irradiated with the ultraviolet radiation in the first step. Therefore, when curing the ink adhering onto the printing medium by irradiating the ink with the ultraviolet radiation output from the ultraviolet radiation unit multiple times, for example, it is possible to cure the ink to some extent in one irradiation of the ultraviolet radiation so that there is time for the ink to become flat, and to cure the ink in the subsequent irradiation of the ultraviolet radiation to such an extent that the ink does not mix with a new ink deposited on it. Therefore, the inks can be cured before the inks mix and after the inks have become sufficiently flat.

Obviously, numerous modifications and variations of the present invention are possible in light of the above teachings. It is therefore to be understood that within the scope of the appended claims, the invention may be practiced otherwise than as specifically described herein.

The invention claimed is:

1. An inkjet printer comprising:

a guide rail that faces a medium support member and that is relatively movable in a moving direction with respect to a printing medium supported by the medium support member, the guide rail extending in a scanning direction substantially perpendicular to the moving direction;

a head device comprising:

a carriage movable in the scanning direction along the guide rail;

a printer head mounted on the carriage and configured to discharge an ink toward the printing medium; and an ultraviolet radiation device mounted on the carriage and configured to output an ultraviolet radiation toward the printing medium thereby curing the ink that has adhered onto the printing medium after being discharged from the printer head, the ultraviolet radiation device comprising:

a first ultraviolet radiator arranged on a first side with respect to the printer head in the scanning direction and configured to output an ultraviolet radiation toward the printing medium; and a second ultraviolet radiator arranged on a second side with respect to the printer head in the scanning direction and configured to output an ultraviolet radiation toward the printing medium, the second side being opposite to the first side with respect to the printer head in the scanning direction; and an intensity controller configured to independently control intensities of ultraviolet radiations output from the first ultraviolet radiator and the second ultraviolet radiator, the intensity controller being configured to independently control, depending on a direction of movement of the carriage, the first ultraviolet radiator and the second ultraviolet radiator to output ultraviolet radiations having intensities different from each other while the carriage moves in the scanning direction, wherein the intensity controller is configured to control the intensities such that a first ratio of an intensity of an ultraviolet radiation output from the first ultraviolet radiator to an intensity of an ultraviolet radiation output from the second ultraviolet radiator when the carriage moves to the first side is substantially equal to a second ratio of an intensity of an ultraviolet radiation output from the second ultraviolet radiator to an intensity of an ultraviolet radiation output from the first ultraviolet radiator when the carriage moves to the second side, and wherein the ultraviolet irradiation output from the first ultraviolet radiator and the ultraviolet irradiation output from the second ultraviolet radiator are both greater than zero when the carriage moves to the first side and when the carriage moves to the second side.

2. The inkjet printer according to claim 1, wherein the first ultraviolet radiator includes a first light emitting diode configured to output an ultraviolet radiation, wherein the second ultraviolet radiator includes a second light emitting diode configured to output an ultraviolet radiation, wherein the intensity controller is configured to control an intensity of the ultraviolet radiation output from the first light emitting diode by controlling a magnitude of an electric current supplied to the first light emitting diode, and wherein the intensity controller is configured to control an intensity of the ultraviolet radiation output from the second light emitting diode by controlling a magnitude of an electric current supplied to the second light emitting diode.

3. A method for printing comprising:

discharging an ink from a printer head of an inkjet printer toward a printing medium while moving the printer head toward a first side along the scanning direction;

independently controlling intensities of ultraviolet radiations output from a first ultraviolet radiator and a second ultraviolet radiator using an intensity controller to output an ultraviolet radiation having a first intensity and an ultraviolet radiation having a second intensity from the first ultraviolet radiator and the second ultraviolet radiator, respectively, of the printer head toward a region in the printing medium to cure the ink that has adhered onto the printing medium after being discharged from the printer head while moving the printer head toward the first side along the scanning direction, the first ultraviolet radiator being arranged on the first side with respect to the printer head in the scanning direction, the second ultraviolet radiator being arranged on a second side with respect to the printer head in the scanning direction, the second side being opposite to the first side with respect to the printer head in the scanning direction, the second intensity being different from the first intensity;

discharging an ink from the printer head toward the printing medium while moving the printer head toward the second side along the scanning direction; and independently controlling intensities of ultraviolet radiations output from the first ultraviolet radiator and the second ultraviolet radiator using the intensity controller to output an ultraviolet radiation having a third intensity and an ultraviolet radiation having a fourth intensity from the first ultraviolet radiator and the second ultraviolet radiator, respectively, to cure the ink while the printer head moves toward the second side along the scanning direction, toward the region in the printing medium, the fourth intensity being different from the third intensity, wherein a first ratio of the first intensity of the ultraviolet radiation output from the first ultraviolet radiator to the second intensity of the ultraviolet radiation output from the second ultraviolet radiator is controlled when the printer head moves to the first side is substantially equal to a second ratio of the fourth intensity of the ultraviolet radiation output from the second ultraviolet radiator to the third intensity of the ultraviolet radiation output from the first ultraviolet radiator when the printer head moves to the second side, and wherein the ultraviolet irradiation output from the first ultraviolet radiator and the ultraviolet irradiation output from the second ultraviolet radiator are both greater than zero when the printer head moves to the first side and when the printer head moves to the second side.

4. The inkjet printer according to claim 1, wherein the first ultraviolet radiator includes a first light emitting diode configured to output an ultraviolet radiation, wherein the second ultraviolet radiator includes a second light emitting diode configured to output an ultraviolet radiation, wherein the intensity controller is configured to control an intensity of the ultraviolet radiation output from the first light emitting diode by controlling a magnitude of an electric current supplied to the first light emitting diode, and wherein the intensity controller is configured to control an intensity of the ultraviolet radiation output from the second light emitting diode by controlling a magnitude of an electric current supplied to the second light emitting diode.

5. The inkjet printer according to claim 1, wherein the intensity controller controls the first ultraviolet radiator to output an ultraviolet radiation having a first intensity while the carriage moves to the first side in the scanning direction, wherein the intensity controller controls the second ultraviolet radiator to output an ultraviolet radiation having a second intensity while the carriage moves to the first side in the scanning direction, and wherein the second intensity is greater than the first intensity.

6. The inkjet printer according to claim 5, wherein the intensity controller controls the first ultraviolet radiator to output an ultraviolet radiation having a third intensity while the carriage moves to the second side in the scanning direction, wherein the intensity controller controls the second ultraviolet radiator to output an ultraviolet radiation having a fourth intensity while the carriage moves to the second side in the scanning direction, and wherein the third intensity is greater than the fourth intensity.

7. The inkjet printer according to claim 6, wherein the first intensity is a half of the second intensity.

8. The inkjet printer according to claim 7, wherein the fourth intensity is a half of the third intensity.

9. The method according to claim 3, wherein the second intensity is greater than the first intensity.

10. The method according to claim 9, wherein the third intensity is greater than the fourth intensity.

11. The method according to claim 10, wherein the first intensity is a half of the second intensity.

12. The method according to claim 11, wherein the fourth intensity is a half of the third intensity.

* * * * *